US008298130B2

(12) United States Patent
Maloney

(10) Patent No.: US 8,298,130 B2
(45) Date of Patent: Oct. 30, 2012

(54) CONTAMINATION DETAINMENT UNIT

(76) Inventor: Raymond C. Maloney, Northport, NY (US)

( * ) Notice: Subject to any disclaimer, the term of this patent is extended or adjusted under 35 U.S.C. 154(b) by 577 days.

(21) Appl. No.: 11/906,705

(22) Filed: Oct. 4, 2007

(65) Prior Publication Data

US 2009/0093671 A1 Apr. 9, 2009

(51) Int. Cl.
*A61G 10/00* (2006.01)

(52) U.S. Cl. ..... 600/21; 135/128

(58) Field of Classification Search ..... 600/21, 600/22; 135/121–128, 139–140
See application file for complete search history.

(56) References Cited

U.S. PATENT DOCUMENTS 4,670,921 A * 6/1987 Avni et al. ..... 5/627
6,241,653 B1 * 6/2001 Gauger et al. ..... 600/21
6,461,290 B1 * 10/2002 Reichman et al. ..... 600/21
6,971,985 B2 * 12/2005 Perlatti ..... 600/21
2005/0004423 A1 * 1/2005 Shenosky et al. ..... 600/21
2006/0247487 A1 * 11/2006 Arts et al. ..... 600/21

* cited by examiner

*Primary Examiner* — Charles A Marmor, II
*Assistant Examiner* — Carrie R Dorna
(74) *Attorney, Agent, or Firm* — Leo G. Lenna, Esq.

(57) ABSTRACT

A mobile isolation unit which forms a chemical and biological barrier that is has a substantially rectangular-parallelepiped shaped enclosure and a frame system configured to support the enclosure in the suspended position so as to create and internal and external environment. The enclosure may also be equipped with at least one opening for access into and out of the enclosure, a zipper for opening and closing the access port, at least one biomedical port, and a plurality of support points configured to support the enclosed in the suspended position when the frame is in an open position so that a patient can be placed in and out of the enclosure. A method for isolating and treating a patient using the mobile isolation unit is also provided.

16 Claims, 6 Drawing Sheets

(KIT)

CONTAMINATION DETAINMENT UNIT

FIELD OF THE INVENTION

This invention relates generally to the field of emergency medical transport care. In particular, the present invention relates to a medical containment unit for transporting persons that have been or are suspected of being contaminated with suspected or known hazardous materials, such as chemical spills, biological agents, or other biohazards. The body containment unit of the present invention is designed to provide protection to rescue and medical personnel while allowing access to a patient in need of medical assistance.

BACKGROUND OF THE INVENTION

In certain disaster or disease situations, it is often necessary to immediately provide emergency care prior to the patient being decontaminated or properly accessed whether the patient has a highly contagious disease or has been subjected to a biological agent. For example, in a situation such as a hazardous chemical spill or the deliberate or accidental release of lethal toxins, diseases, or other a biological contaminants (hereinafter referred to generally as a biohazards), patients in and of themselves may represent a danger, especially to first responders providing medical and rescue assistance. In addition, transportation of these victims to local hospitals and medical facilities are often required to save the life of the victims but, doing so without taking precautions will result in contaminating all environments that the patient comes in contact. This often includes the ambulance or transportation vehicle to the medical facility, the medical facility itself and any other area or staging area in the interim. The patient may also contaminate other victims resulting in many ambulances being contaminated, many medical facilities becoming contaminated as well as many medical personnel. The problem is only intensified in the state of a national disaster.

Most rescuers have a procedure in place to safeguard the ambulance, holding area or hospital, as best they can, from becoming contaminated by a patient exposed to a biohazard. Such procedures include, but are not limited to, covering the inside of the ambulance with tarps or protective sheets that can be easily disposed of once the patient disembarks. However, since the ambulance is usually limited in space with many drawers, cabinets and closets holding drugs, bandages and other medical equipment, this minimal protective coating is often breached during the transportation of the patent to the medical facility. In addition, once the contaminated patient is removed form the ambulance, unless the same or similar procedures that were taken to protect the ambulance form being contaminated is taken to protect the medical facility, i.e. drape protective sheets on the walls, floors, ceilings, equipment and doors, then contamination of the facility is likely to occur. Even if these procedures are taken and are preserved during transport and treatment, depending on the type of biohazard contamination, the protective measures may not be enough to protect contamination of these areas.

For example, these measures may be sufficient to protect against mild chemical contamination but not radiological and/or biological toxins and/or diseases. Moreover, even if they were sufficient, decontaminating the protective site is costly, time intensive and often not able to be done without contaminating the site being decontaminated. Even if all contaminated protective materials are collected and the site is left uncontaminated, the task still remains to discard these materials without contaminating disposal facilities and non-medical personnel.

Accordingly, there is a need in the market today for a bio-hazardous containment unit that can be easily deployed, allows access to the patient so that medical assistance can be provided, is effective in protecting against contamination of people and areas that come in contact with the contaminated patient, requires little to no decontamination after it is deployed and requires minimal resources and efforts to dispose of once it is no longer needed. The contamination detainment unit described herein satisfies this market need. The present invention is further described in the sections and figures set forth below.

SUMMARY OF THE INVENTION

The present invention is directed to a mobile isolation unit that can be used in the medical field to treat chemically or biological contaminated patients while limiting exposure of the treatment or transporting facility and medical personnel to the chemical and/or biological contaminants. One embodiment of the present invention is directed to a mobile isolation unit comprising a substantially rectangular-parallelepiped shaped enclosure and a frame system configured to support the enclosure. The enclosure further comprises at least one opening for access into and out of the enclosure. The opening can be opened and closed using a closure means such as a zipper. The zipper may be equipped with a special flap containing a Velcro®-type material that can be used to cover the zipper once it is closed so as to assure that the zipper is virtually airtight. The enclosure is also equipped with a plurality of support points designed to attach to a frame and support the enclosure in a suspended, non-collapsed configuration. Once in the suspended position the enclosure has an internal environment that is separate from an external environment. The patient may be placed into the internal environment of the enclosure wherein isolating the patient from the medical environment around him or her. The patient in the isolation unit may then be transported to a health care facility without contaminating the transport vehicle and/or medical personnel treating the patient.

In another embodiment of the invention the mobile isolation unit comprises a frame having a plurality of support poles configured to interconnect with each other to form a continuous frame having a base, a first support bar located at one end of the frame and a second support bar located at the opposite end of the frame. The first and second support bars of the frame are configured to have a plurality of support point attachment means so that an enclosure as described above can be attached. Once attached, the enclosure will be configured in the suspended, non-collapsed orientation making it easy for a patient to be placed in or taken out of an opening in the enclosure while protecting the surrounding environment and medical personnel from contamination.

In yet another embodiment of the present invention, a method for isolating and treating a patient using the isolation unit described above is provided. The method comprises placing a patient into the enclosure of the isolation unit via the access opening of the enclosure. Once the patient is safely inside the enclosure, the zipper can be closed and outer flap secured so as to assure containment of any contaminates. Once secured, the patient can be treated at the site or optionally transported in the isolation unit by ambulance for further treatment without the worry of contaminating the ambulance of the treatment facility once the patient arrives. Once the patient is removed from the isolation unit, the enclosure can either be decontaminated or discarded and another enclosure secured to the frame in preparation for the next use.

The present invention is further described using the figures and detailed description provided below.

BRIEF DESCRIPTION OF THE INVENTION

DETAILED DESCRIPTION OF THE INVENTION

The mobile personnel bio-isolation enclosure unit of the present invention is designed so as to attach to a collapsible portable frame and is sized so as to fit a patient when in the horizontal position. The collapsible frame and enclosure allows medical personnel to easily store the unit either in an ambulance and/or a fire rescue truck so that it can be accessed when needed. That is, when it is determined that a patient is infected with a highly infectious disease or has been contaminated with a chemical or biological agent and is in need of medical treatment, the mobile personnel bio-isolation enclosure unit of the present invention can be used. Using the mobile personnel bio-isolation enclosure unit of the present invention reduces the risk of contaminating other people, such as, health professionals, when the patient is placed inside the contamination containment enclosure of the present invention.

Once inside the enclosure, the patient can receive medical attention and the medical personnel attending to the patient are protected against the contaminating agent. In addition, the ambulance as well as other places that the patient may come in contact with while receiving medical treatment would also be protected from becoming contaminated.

In some cases were an ambulance becomes contaminated, the time it takes to de-contaminate the ambulance is not only expensive but takes the much needed ambulance out of service. In other cases where the ambulance is not properly decontaminated then other patients, often with compromised immune systems to begin with, can become infected by the biological agents that remain in the ambulance. Therefore, it is better to limit the contact with a patient that is either sickened by a highly infection disease, such as hepatitis or viral meningitis, or has come in contact with a chemical or biological agent. However, prior to the present invention, this has been a major challenge for medical professional. The mobile personnel bio-isolation enclosure unit of the present invention provides a way for medical professional to quickly limit their exposure to the patient, as well as, the patient's contact with medical transport and care facilities, while providing medical care.

Figure 1:
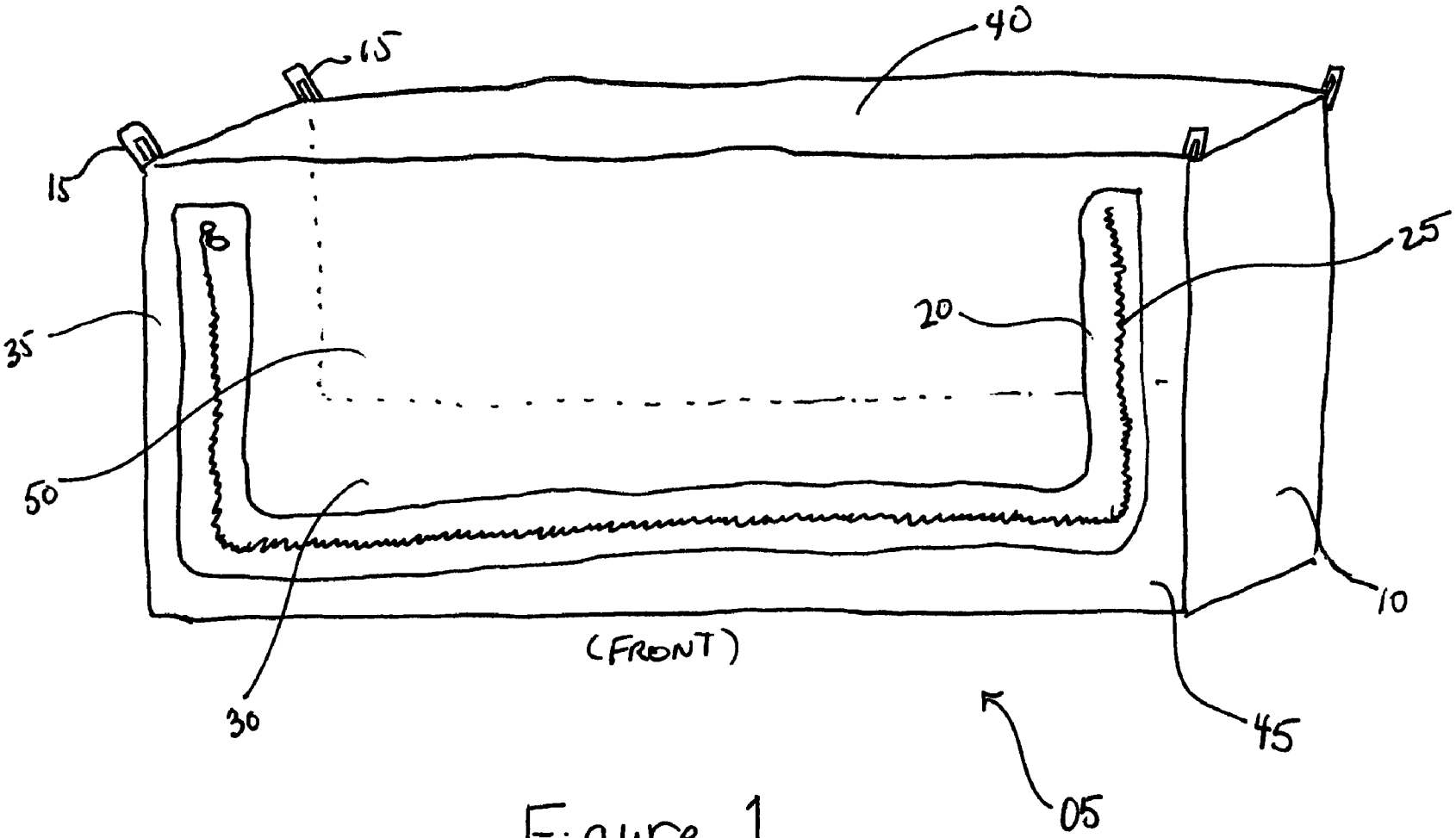
FIG. 1 is a sectional front view of the mobile personnel bio isolation enclosure unit of the present invention.

Referring now to the figure, wherein like numbers indicate like parts, in particular FIG. 1, shows a sectional front view of the mobile personnel bi-isolation enclosure unit of the present invention. The bio-isolation enclosure unit of the present invention is designed so as to attach to the frame (shown in FIG. 3) and is sized so as to fit a patient when the patient is lying in a horizontal position. The body enclosure (05) of the present invention has a front panel (30), a back panel (50), a left side panel (35), a right side panel (10), a top panel (40) and a bottom panel (45) all of which are attached together to form an enclosure that separates the external environment from an internal environment. The enclosure can be seamless or if seams are used in the production of the enclosure, the seams must be hermetically sealed to prevent chemical and biological agents from leaking from the enclosure.

The front panel (30) comprises a zipper (25) that is covered by a protective cover (20). The zipper (25) forms a continuous substantially three-sided opening with the forth side being used as a hinge. That is, the zipper (25) can be unzipped and a flap separated from the rest of the front panel (30). The separated flap remains attached to the rest of the front panel (30) by the forth portion, i.e., the hinge, that is continuous with the rest of the front panel (30). The unzipped portion of the flap that acts as a hinge can be located either at the bottom or top of the continuous substantially three-sided zipper configuration so that when the zipper (25) is unzipped the three-sided flap will either fold down or fold up so that a patient can be placed into the enclosure.

Once the patient is inside the enclosure, the zipper (25) can be re-zipped and the flap secured to the rest of the front panel creating the enclosure. Once the zipper (25) has been zipped, the protective cover (20) can be closed on top of the zipper so as to prevent any biological and/or chemical agents from leaking out of the enclosure via the zipper. The protective cover (20) can be fastened either by Velcro®, Zip-lock®, or some other means for closing the protective cover (20).

Attached to the upper portion of the body enclosure (05) is a plurality of support points (15). The support points (15) are configured so that they can be attached to the frame (shown in FIG. 3) so as to keep the body enclosure (05) in the non-collapsed configuration. The supports points (15) can be reinforced with metal and/or other man-made materials so as to prevent them from tearing away from the body enclosure (05).

Figure 2:
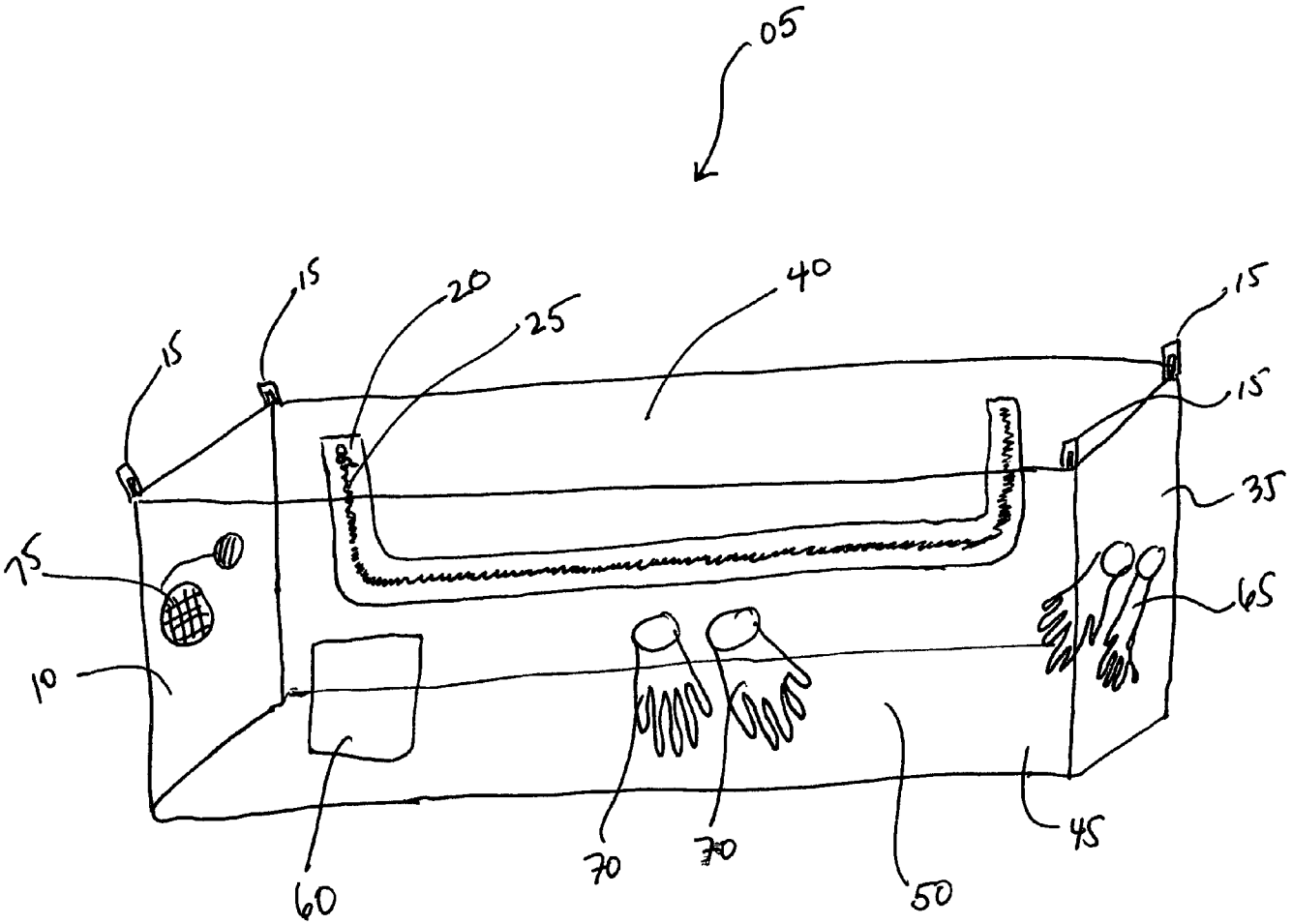
FIG. 2 is a sectional back view of the mobile personnel bio isolation enclosure unit of the present invention.

The body enclosure (05) is further described in FIG. 2 which shows the enclosure of the present invention with the back panel (50) facing towards the viewer. The back panel (50) is further equipped with medical gloves (70) which can be used by a medical professional to administer medicine and/or care to a patient placed into the body enclosure (05) without physically coming in contact with the patient. As shown in FIG. 2, additional medical gloves (65) can either be on the left panel (35) as shown, on the right side panel (10) (not shown), or on the front panel (not shown). If the gloves are on the front panel (30), they can either be on the portion of the front panel (30) that zippers away from the rest of the front panel (30), on the stationary portion of the front panel or on both. Various designs, number of gloves used and placement of the gloves on the body enclosure of the present invention can be used. All of these glove arrangements fall within the general scope of the invention. The gloves can be attached to the body enclosure by an attachment means that allows the gloves to be changed should the enclosure be reconditioned and reused.

In FIG. 2, the right panel can be equipped with at least one medical port (75) which can be designed to provide intravenous connections, oxygen connections, HEPA filters, air conditioning, heating means, vapor or other medical devices that may have to be used to treat the patient. Also shown in FIG. 2, attached to at least one panels is a clear sleeve that can be used as a medical record holder (60). This allows medical personnel to have access to the patient's medical files when treating the patient.

Figure 3:
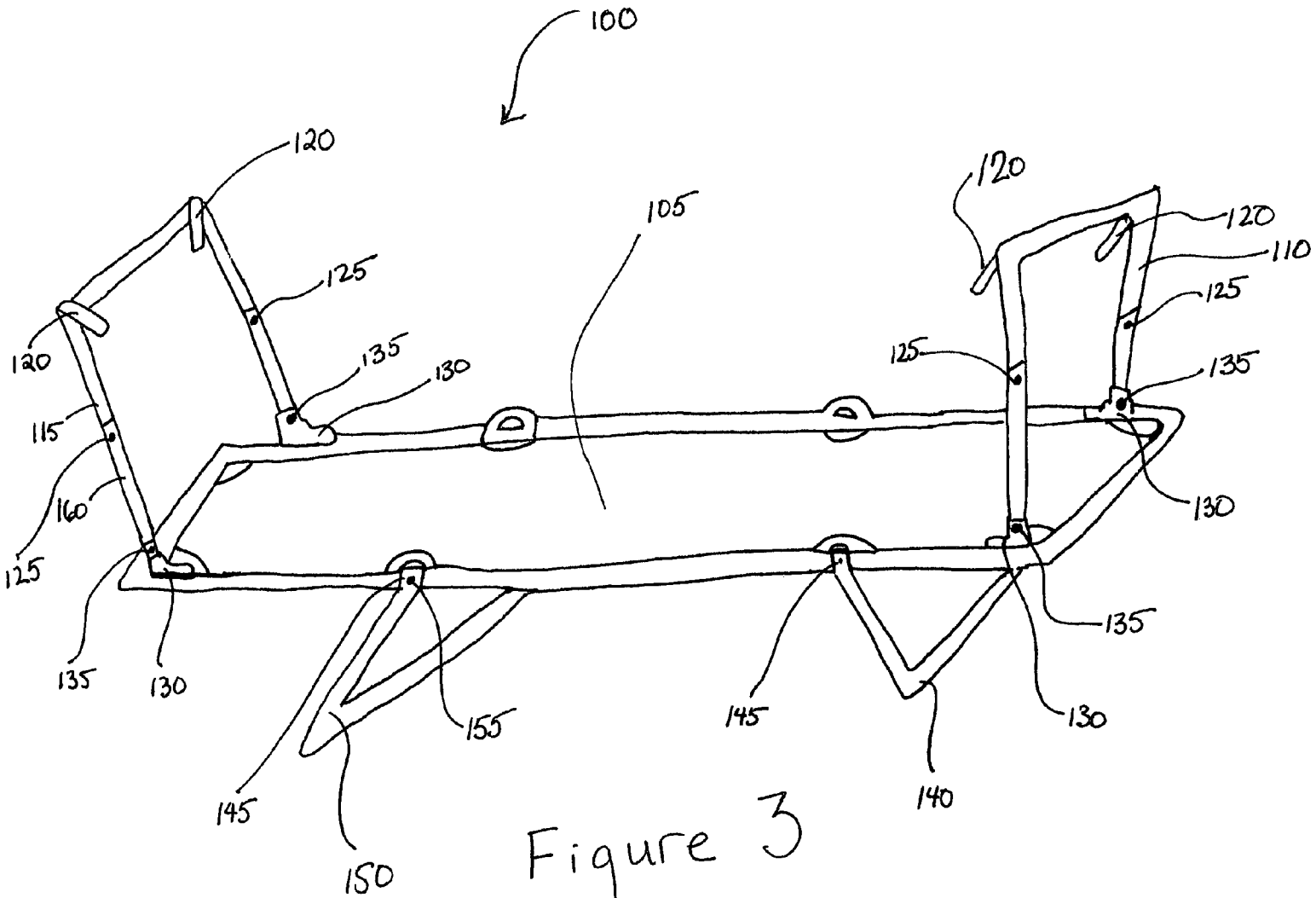
FIG. 3 is a prospective view of the frame of the personnel bio isolation unit of the present invention.

As stated above, and shown in FIG. 3 of the present invention, the present invention may be equipped with a frame (100). The frame (100) provides a support for both the body enclosure (05) and the patient while providing a mobile structure that is used to hold the body enclosure (05) in an open position. The frame (100) comprises a horizontal support gurney (105) designed to support a patient once the patient is placed into the body enclosure attached to the frame (100) by the support points. The frame (100) is supported off of the floor by a plurality of legs. FIG. 3 is shown with a left leg (150) and a right leg (140) but it is well within the scope of the invention to use more than 2 legs and/or place wheels on the legs.

The right leg (140) and the left leg (150) are attached to the frame of the horizontal support gurney (105) by locking hinges (145). The locking hinges (145) are equipped with locking push pins (135) and (155) that when depressed release the lock on the locking hinges (145) and allow the right and left legs to fold under the frame. When the frame needs to used, the legs can be locked in place so as to be in the support position snap into place and lock the hinge in the open (usable) position.

At the far ends of the frame of the horizontal support gurney (105) are a plurality of locking hinges (130) that are attached to a left support pole (115) and a right support pole (110) that are designed to attach to the body enclosure as shown in FIGS. 1 and 2. The left and right support poles (160,110) have two upwardly pointing rods connected together by a transverse rod making an upside down u-shaped structure. Although this is a preferred embodiment, other embodiments that provide support can also be used in practicing the present invention. The left and right support poles (160,110) have a plurality of attachment means (120) in communication with the left and right support poles (160,110) which are configured to receive the support points (15) of the body enclosure (05) as showed in FIGS. 1 and 2 and described above.

Once attached, the body enclosure is supported in the non-collapsed position creating an internal space that is isolated from the outside environment. The bottom panel (55) of the body enclosure shown in FIGS. 1 and 2, rests on the horizontal support gurney (105), that together with the support poles provide ample support for the body enclosure (05). Once attached, the mobile personnel bio-isolation enclosure unit (05) of the present invention is fully operational.

The right and left support poles (160,110) are also attached to the frame of the horizontal support gurney (105) by locking hinges (130) which may also comprise locking pins (135). As with the legs of the present invention, the locking pins (135) of the support poles can be depressed and the support poles folded down into a storage position. When the body enclosure (05) needs to be attached to the support poles, the locking pins can be depressed and the support poles placed into the locked position.

The right and left support poles (160,110) can also be equipped with a telescopic securing pins (125) located at about the mid point of the support poles. The telescopic securing pins (125) can be depressed and the support poles configured so that the portion above the telescopic locking pins telescopes into the bottom half of the support poles to reduce the overall size of the support poles. This makes it easier to store the mobile bio-isolation enclosure unit of the present invention. Similar in action to the locking pins of the legs and support poles, the support poles can be re-extended to the full position and the telescopic securing pins (125) snapped into the locked position so as to lock the support poles in place. In this position, the support poles are ready to accept the support points (15) of the body enclosure (05) and support the enclosure in a non-collapsed configuration.

Finally, in one embodiment of the present invention, the locking hinges for the legs (145) can also be configured so as to allow the horizontal support gurney (105) to fold about the hinges and allow the left and right portions of the gurney to fold in towards the center of the gurney in order to reduce the overall length of the horizontal support gurney (105). The locking pins for the legs (155) may also be utilized to lock the folded gurney portions into place once extended to the preferred position. In the alternative, additional locking means can be used for this task.

Figure 4:
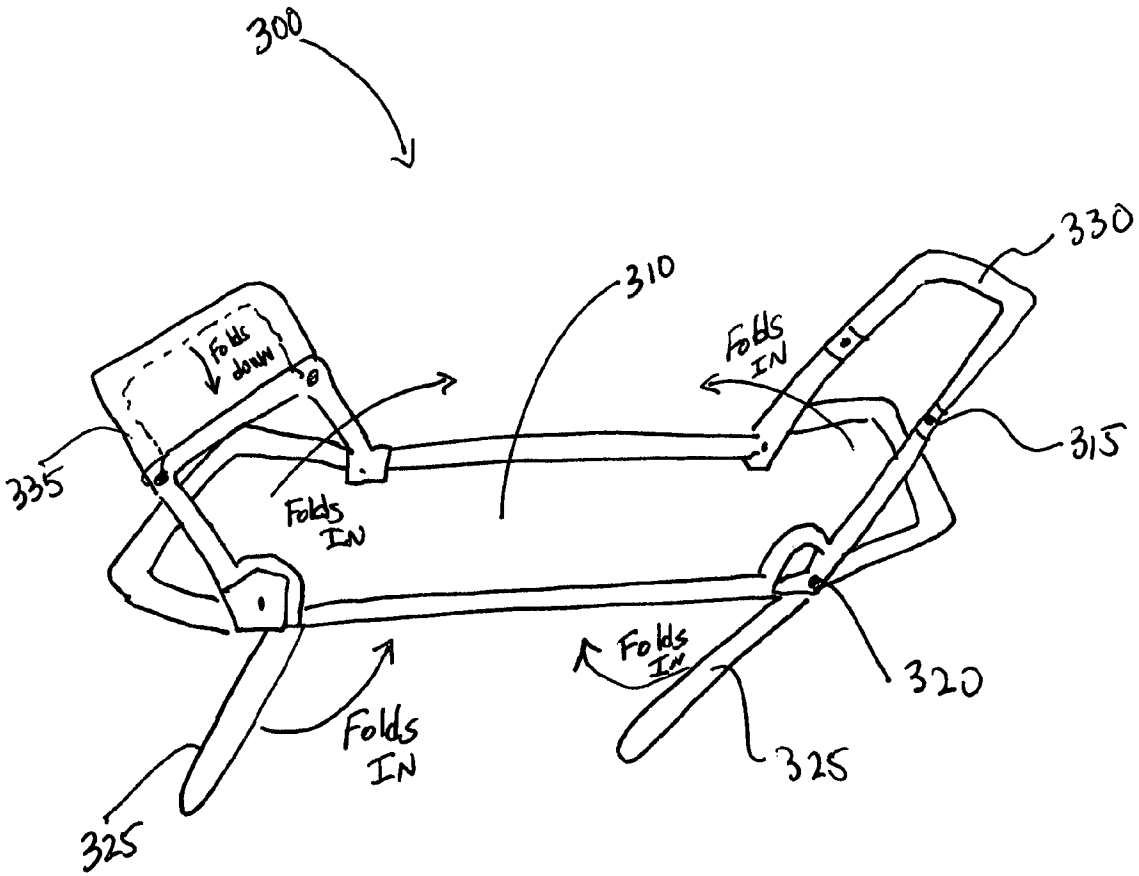
FIG. 4 is a side view of the frame partially folded of the present invention.

FIG. 4 shows the folding frame (300) providing a horizontal support gurney (310) and the telescoping support poles (335,330) in the process of being converted from the open to the closed position. Support pole (330) is collapsed by depressing telescopic securing pins (315) and folded inwardly by depressing locking pins (320) for storage. In addition, FIG. 5 also shows the right leg (325) being folded inward towards the frame while the left leg (325) is still fully extended as discussed above.

Figure 5:
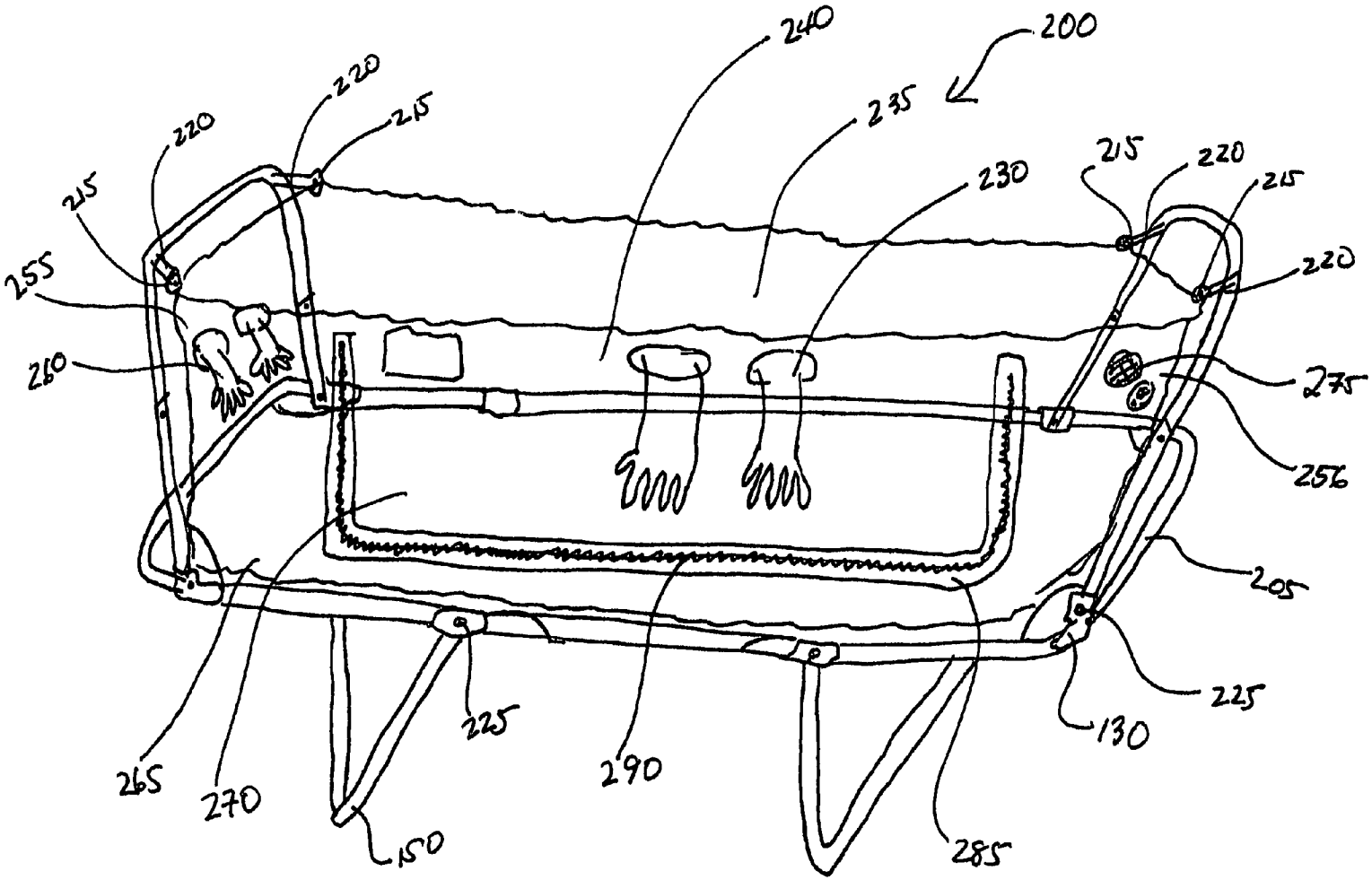
FIG. 5 is a prospective front view of the personnel bio-isolation unit comprising the frame and the enclosure of the personnel bio isolation unit of the present invention.

FIG. 5 shows the mobile bio-isolation enclosure unit (200) of the present invention body comprising the frame (205) and the body enclosure attached to the frame (205). The body enclosure having a front panel (270), a back panel (240), a left side panel (255), a right side panel (256), a top panel (235) and a bottom panel (265) all attached together to form an enclosure that separates the external environment from an internal environment. The front panel (270) comprises a zipper (290) that is covered by a protective cover (285). The supporting points (215) of the enclosure are attached to the attachment means (220) of the frame (205) conforming the enclosure in the non-collapsed configuration. As also shown in FIGS. 1 and 2, the enclosure is equipped with back gloves (230) and side gloves (260) for providing medical care for the patient placed inside the enclosure. FIG. 5 also shows the legs (275) in the extended position thereby supporting the horizontal gurney off of the ground. The enclosure may also be equipped with medical ports (275) as discussed above and shown in FIGS. 1 and 2. Additional ports and attachments may also be provided so as aid in the art of providing medical care to a patient as long as the isolation of the patient is maintained.

Figure 6:
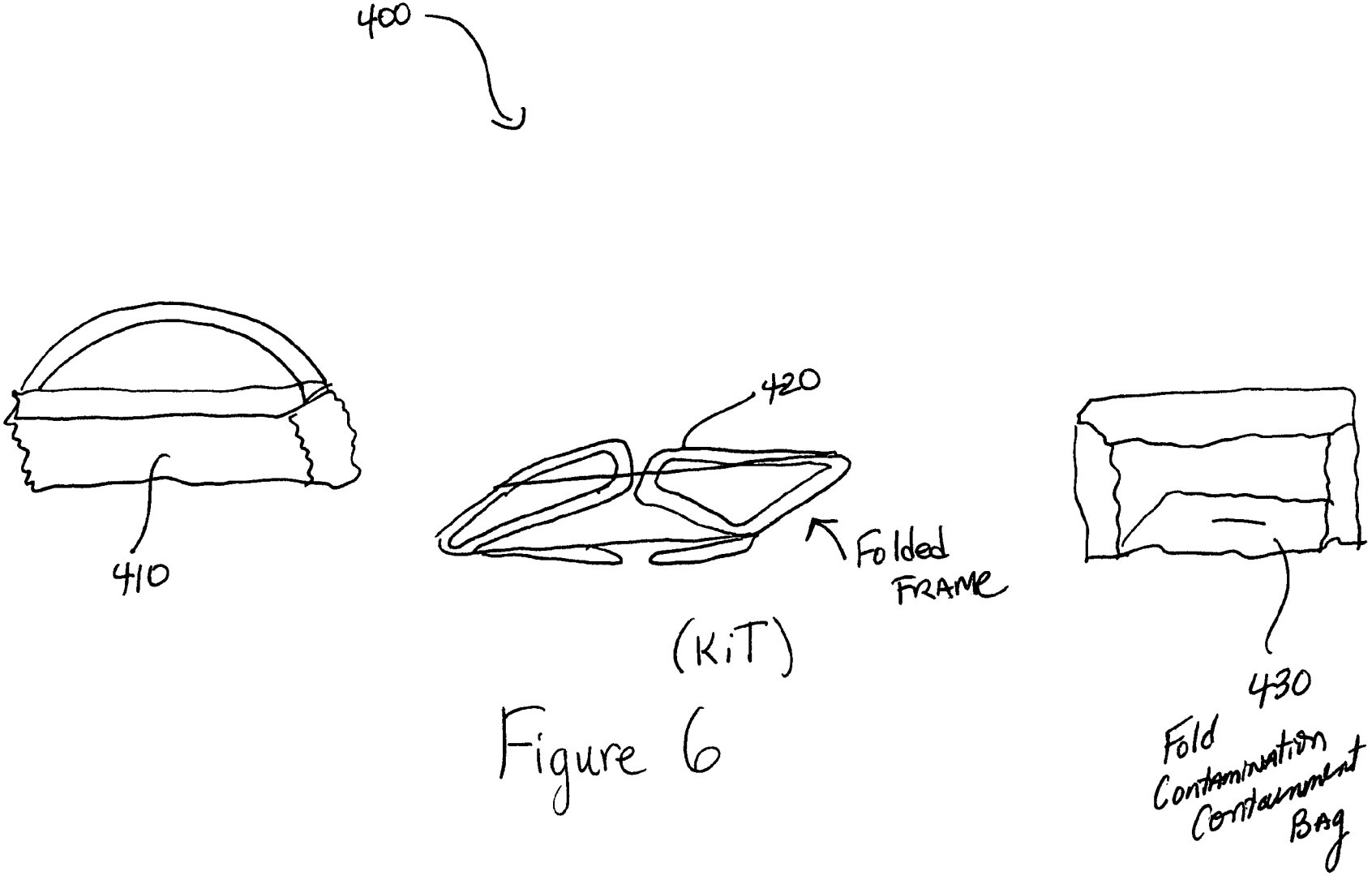
FIG. 6 is a kit containing the folded support frame and the folded personnel bio isolation containment enclosure of the present invention.

It is within the scope of the invention to provide a kit (400) containing the frame (420), at least one body containment enclosure (450) and a carrying bag (410). As shown in FIG. 6, the carrying bag (410) will be large enough to hold the frame (420) in the folded configuration, and at least one body containment enclosure (430) in the collapsed configuration. Additional body containment enclosures (430) can be provided since it is contemplated by the present invention that the body containment enclosure can be disposed of, the frame de-contaminated, and the device used over and over again.

The mobile personnel bio-isolation enclosure unit of the present invention is specifically designed to be a stand alone unit and not depend on any external support bars, such as bars attached to the ceiling of an ambulance or in an operating room, in order to be operational. This allows the mobile personnel bio-isolation enclosure unit of the present invention to be used in the field, on the street, in combat zones, during outside natural disasters, and acts of chemical and bio-terrorism. This autonomy makes the present invention more versatile and mobile than ones that depend on external structural support. And the unique folding frame makes the present invention a valuable tool in caring for potential chemical and bio-terrorism victims in the filed or at the site of impact.

The present invention is also directed to a method for isolating and treating a patient using the mobile personnel bio-isolation enclosure unit of the present invention. The method entails placing a patient into the enclosure of the bio-isolation unit of the present invention. Once the patient is inside, the enclosure and is secured using the zipper or other closure means of the body containment enclosure of the present invention. Once closed, the patient is isolated form the external environment and the patient can either be treated on the site or optionally transported to an ambulance or other vehicle so that said patient can be further treated and transported to a treating medical facility.

Once the patient arrives at a treating medical facility, the zipper or other enclosure means of the body containment enclosure is opened and the patient removed for further medical treatment. In the alternative, the patient can be treated while in the mobile personnel bio-isolation enclosure unit of the present invention. Once the patient is removed either before or after treatment, the body containment enclosure of the present invention can be optionally decontaminated and reused or the frame decontaminated and a new enclosure attached.

The materials used to make the frame and the bio-isolation enclosure may vary according to supply, need, and design. For example, the frame may be made from stainless steel, aluminum, titanium, steel, reinforced poly vinyl chloride PVC), polyethylene piping, resin composites, man-made materials, alloys or mixtures thereof. The materials that are prone to rusting can be anodized or powder coated to prevent rusting. The coating may contain antimicrobial particles that are designed to resist and kill microbes upon contact. In the alternative, the frame may be coated with a powder coating and/or paint that resist mold, fungus and bacterial attachment thereby reducing growth of these microbes. The techniques used to make the frame are well know in the art and one skilled in the art would be equipped to construct either a hollow or solid frame from the materials listed above.

The materials that can be used to make the enclosure include clear or substantially clear polyvinylchloride (PVC), or substantially clear polyurethane, clear or substantially clear resins, man-made materials and/or composites of the same. As with the frame, the enclosure can be coated with antimicrobial materials. The thickness of the enclosure should be thick enough to contain biological and chemical agents and thick enough to have some degree of rigidity so as not to collapse when attached to the frame of the mobile personnel bio-isolation enclosure unit of the present invention. While different combinations of materials can be used to make the frame and the enclosure, these combinations fall within the spirit of the invention.

While the above description contains many specifics, these specifics should not be construed as limitations of the invention, but merely as exemplifications of preferred embodiments thereof. Those skilled in the art will envision many other embodiments within the scope and spirit of the invention as defined by the claims appended hereto.

What is claimed is:

1. A collapsible mobile isolation unit comprising:

a substantially rectangular-parallelepiped shaped enclosure and a separate stand alone frame system configured to support said enclosure, said frame system comprising a plurality of solid support collapsible poles and a base configured as a single unit;

said enclosure comprising a front panel, a back panel, a left side panel, a right side panel, a top panel and a bottom panel all of which continuously attached together to form said enclosure having an internal environment separated from an outside environment, said enclosure further containing at least one access into and out of said enclosure outlined by a closure means for opening and closing said access, at least one biomedical port, and a plurality of support points configured to support said enclosure in a suspended position so as to form an internal environment that is separate from an external environment wherein a patient can be moved in and out of said enclosure through at least one opening for access; and a flap configured to cover said closure means so as to provide a hermetical seal that prevents contaminants from exiting said closure means when said closure means is closed.

2. The mobile isolation unit of claim 1 wherein said plurality of collapsible support poles of said separate stand alone frame are configured to interconnect with each other to form a continuous frame having a base, a first support bar located at one end of said frame and a second support bar located at the opposite end of said frame, said first and second support bars comprising a plurality of support points configured for attachment of said enclosure whereby said enclosure, when attached, is configured to allow a patient to be placed in or taken out of said opening in said enclosure.

3. The mobile isolation unit of claim 2 wherein said separate stand alone frame further comprises a substantially flat support surface that is attached to said first and second support bars of said frame and is substantially perpendicular to said substantially flat support surface so as to provide a surface to support a person placed into said enclosure attached to said first and second support bars of said frame.

4. The mobile isolation unit of claim 2 wherein said separate stand alone frame further comprises support legs attached to said frame and extend downward towards a floor so as to support the weight of said patient placed in said enclosure off of said floor.

5. The mobile isolation unit of claim 1 wherein said separate stand alone frame further comprises at least one stretcher or gurney attachment means located at opposite end of said plurality of support points of said first and second support bars, said stretcher or gurney attachment means configured for attaching said mobile isolation unit to a stretcher or gurney.

6. The mobile isolation unit of claim 1 wherein said closure means is a zipper wherein said zipper when closed is covered by said flap thereby preventing contaminants from escaping said enclosure.

7. The mobile isolation unit of claim 1 wherein said opening is located in a front wall of said enclosure;

an opening is opened and closed by a continuous zipper means having an open and closed position; and said opening has three sides that are equipped with said continuous zipper means and one side that does not open but is continuous with said enclosure whereby said side that does not open acts like a hinge and keeps the open flap attached to said enclosure when said continuous zipper means is in the open position and said flap further comprises a sealing means, said sealing means configured to seal said zipper so as to prevent containments from escaping from said enclosure.

8. The mobile isolation unit of claim 7 wherein said sealing means is a fastening tape consisting of a strip of nylon with a surface of minute hooks that fasten to a corresponding strip with a surface of uncut pile.

9. The mobile isolation unit of claim 7 wherein said sealing means comprises an interlocking groove and ridge that form a tight seal when pressed together.

10. The mobile isolation unit of claim 1 wherein said enclosure is constructed of material selected from the group consisting of latex, plastic, polyurethane, nylon, manmade materials and mixtures thereof and said materials are either rigid or semi-flexible and said enclosure is at least partially see-through.

11. The mobile isolation unit of claim 1 wherein said enclosure further comprises a filtration system and at least one sleeve glove positioned therein said at least one sleeve glove configured to permit medical personnel to assist a patient within said enclosure without violating the integrity of the of said mobile isolation unit.

12. A method for isolating and treating a patient using an isolation unit comprising:

placing a patient into said enclosure of said isolation unit of claim 1 via an opening for access in said enclosure;

securing said closure means in the closed position so as to isolate said patient in said enclosure form the external environment;

optionally transporting said isolation unit into an ambulance or other vehicle so that said patient can be further treated.

13. The method for isolating and treating a patient using an isolation unit according to claim 12 wherein when said patient arrives at a treating facility said closure means of said enclosure is opened and said patient is removed for further medical treatment; and optionally decontaminating said treating said isolation unit for use at a later time.

14. The mobile isolation unit of claim 1 wherein said front panel, said back panel, said left side panel, said right side panel, said top panel and said bottom panel are seamlessly connected to form said enclosure, whereby said seamless enclosure prevents chemical and biological agents from leaking from said enclosure.

15. The mobile isolation unit of claim 1 wherein said front panel, said back panel, said left side panel, said right side panel, said top panel and said bottom panel seamed together to form said enclosure, all seams being hermetically sealed so that said enclosure prevents chemical and biological agents from leaking from said enclosure.

16. The mobile isolation unit of claim 15 wherein said front panel, said back panel, said left side panel, said right side panel, said top panel and said bottom panel are configured so that said front panel, said back panel, said left side panel, said right side panel, said top panel and said bottom panel form said enclosure, said seams being hermetically sealed so as to prevent chemical and biological agents from leaking from said enclosure.

* * * * *